US010843482B2

(12) United States Patent
Aikawa et al.

(10) Patent No.: US 10,843,482 B2
(45) Date of Patent: Nov. 24, 2020

(54) INK JET RECORDING METHOD AND INK JET RECORDING APPARATUS

(71) Applicant: CANON KABUSHIKI KAISHA, Tokyo (JP)

(72) Inventors: Yoshihide Aikawa, Kawasaki (JP); Minako Kawabe, Koganei (JP); Hideyuki Saito, Saitama (JP); Kouhei Nakagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/158,412

(22) Filed: Oct. 12, 2018

(65) Prior Publication Data

US 2019/0111701 A1 Apr. 18, 2019

(30) Foreign Application Priority Data

Oct. 17, 2017 (JP) ..... 2017-201260
Sep. 26, 2018 (JP) ..... 2018-180361

(51) Int. Cl.

| | |
|---|---|
| ***B41J 2/165*** | (2006.01) |
| ***B41J 2/21*** | (2006.01) |
| ***B41J 2/155*** | (2006.01) |
| ***B41M 5/00*** | (2006.01) |

(52) U.S. Cl.

CPC ..... *B41J 2/21* (2013.01); *B41J 2/155* (2013.01); *B41J 2/16535* (2013.01); *B41J 2/16538* (2013.01); *B41J 2/16585* (2013.01); *B41M 5/0023* (2013.01)

(58) Field of Classification Search

CPC . B41J 2/21; B41J 2/155; B41J 2/16535; B41J 2/16538; B41J 2/16585; B41M 5/0023

See application file for complete search history.

(56) References Cited

U.S. PATENT DOCUMENTS

| | | | |
|---|---|---|---|
| 7,208,033 | B2 | 4/2007 | Kawabe et al. |
| 7,244,299 | B2 | 7/2007 | Tsuji et al. |
| 7,285,159 | B2 | 10/2007 | Aikawa et al. |
| 7,294,184 | B2 | 11/2007 | Fujimoto et al. |
| 7,381,257 | B2 | 6/2008 | Takayama et al. |
| 7,445,325 | B2 | 11/2008 | Aikawa et al. |
| 7,615,113 | B2 | 11/2009 | Aikawa et al. |
| 7,618,484 | B2 | 11/2009 | Fujimoto et al. |
| 7,705,071 | B2 | 4/2010 | Nakagawa et al. |
| 8,025,722 | B2 | 9/2011 | Kawabe et al. |

(Continued)

FOREIGN PATENT DOCUMENTS

JP 2005-342982 A 12/2005

*Primary Examiner* — Yaovi M Ameh

(74) *Attorney, Agent, or Firm* — Venable LLP

(57) ABSTRACT

An ink jet recording method, which uses an ink jet recording apparatus including: first and second inks corresponding to aqueous inks containing a pigment; a recording head in which a first ejection orifice array for ejecting the first ink and a second ejection orifice array for ejecting the second ink are sequentially arranged from the bottom in the direction of gravity to be adjacent to each other and the first and second ejection orifice arrays are arranged to at least partially overlap each other; and a cleaning member, includes: recording; and cleaning, wherein at least one of the first and second inks contains a resin, and a content of the resin in the second ink is larger than a content of the resin in the first ink.

15 Claims, 6 Drawing Sheets

(56) References Cited

U.S. PATENT DOCUMENTS

| | | | | |
|---|---|---|---|---|
| 8,070,871 | B2 | 12/2011 | Kawabe et al. | |
| 9,574,099 | B2 | 2/2017 | Kawabe et al. | |
| 9,598,592 | B2 | 3/2017 | Nakata et al. | |
| 2006/0238565 | A1* | 10/2006 | Jung | B41J 2/2139 347/37 |
| 2012/0218335 | A1* | 8/2012 | Kondo | B41J 2/2132 347/13 |
| 2017/0165979 | A1* | 6/2017 | Ohta | B41M 7/009 |
| 2017/0232750 | A1* | 8/2017 | Takino | B41J 2/16517 347/33 |
| 2019/0111702 | A1* | 4/2019 | Saito | B41J 2/211 |

* cited by examiner

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

Recently, an opportunity to use an ink jet recording apparatus in a commercial printing field and an office printing field has increased. In the commercial printing field and the office printing field, miniaturization of the ink jet recording apparatus is required. In order to miniaturize the apparatus, it has been studied to shorten a conveying distance of a recording medium by using a recording head in which an ejection orifice surface of the recording head is inclined with respect to the direction of gravity (see Japanese Patent Application Laid-Open No. 2005-342982). Further, it has been studied to use a plurality of recording heads corresponding to a plurality of inks of colors such as cyan, magenta, yellow, and black (see Japanese Patent Application Laid-Open No. 2005-342982).

In order to miniaturize the apparatus, the present inventors used a recording head having a plurality of ejection orifice arrays for ejecting a plurality of inks instead of using a plurality of recording heads corresponding to the plurality of inks. A study was conducted using a recording head having the plurality of ejection orifice arrays for ejecting the plurality of inks while an ejection orifice surface of the recording head was inclined with respect to the direction of gravity. As a result, it was found that, when ink ejected from the recording head and adhered to the ejection orifice surface is removed by a cleaning member, color mixing may occur in an image to be recorded later.

SUMMARY OF THE INVENTION

An object of the present invention is to provide an ink jet recording method capable of suppressing color mixing in images even in the case in which ink adhered to an ejection orifice surface inclined with respect to the direction of gravity and having a plurality of ejection orifice arrays for ejecting a plurality of inks is removed by a cleaning member. Another object of the present invention is to provide an ink jet recording apparatus using the ink jet recording method as described above.

According to an embodiment of the present invention, there is provided an ink jet recording method using an ink jet recording apparatus including: first and second inks corresponding to aqueous inks containing a pigment; a recording head in which a first ejection orifice array for ejecting the first ink and a second ejection orifice array for ejecting the second ink are sequentially arranged from the bottom in the direction of gravity to be adjacent to each other and the first and second ejection orifice arrays are arranged to at least partially overlap each other in a conveying direction of a recording medium; and a cleaning member cleaning an ejection orifice surface of the recording head in which the first and second ejection orifice arrays are formed, the ink jet recording method including: ejecting the aqueous ink from the recording head disposed so that an angle formed between the ejection orifice surface and the direction of gravity is 0° or more to less than 90° to record an image on the recording medium; and cleaning the ejection orifice surface, wherein at least one of the first and second inks contains a resin, and a content of the resin in the second ink is larger than a content of the resin in the first ink.

According to another embodiment of the present invention, there is provided an ink jet recording apparatus including: first and second inks corresponding to aqueous inks containing a pigment; a recording head in which a first ejection orifice array for ejecting the first ink and a second ejection orifice array for ejecting the second ink are sequentially arranged from the bottom in the direction of gravity to be adjacent to each other and the first and second ejection orifice arrays are arranged to at least partially overlap each other in a conveying direction of a recording medium; and a cleaning member for cleaning an ejection orifice surface of the recording head in which the first and second ejection orifice arrays are formed, wherein an image is recorded on the recording medium by ejecting the aqueous ink from the recording head disposed so that an angle formed between the ejection orifice surface and the direction of gravity is 0° or more to less than 90°, the ejection orifice surface is cleaned, at least one of the first and second inks contains a resin, and a content of the resin in the second ink is larger than a content of the resin in the first ink.

According to the present invention, it is possible to provide the ink jet recording method and the ink jet recording apparatus capable of suppressing color mixing in images even in the case in which ink adhered to an ejection orifice surface inclined with respect to the direction of gravity and having a plurality of ejection orifice arrays for ejecting a plurality of inks is removed by a cleaning member.

Further features of the present invention will become apparent from the following description of exemplary embodiments with reference to the attached drawings.

DESCRIPTION OF THE EMBODIMENTS

Hereinafter, embodiments of the present invention are described in detail. In the present invention, hereinafter, in some cases, an aqueous ink is referred to as an "ink". Unless otherwise specified, various physical property values are values at a temperature of 25° C. "(Meth)acrylic acid" and "(meth)acrylate" are described as "acrylic acid and methacrylic acid" and "acrylate and methacrylate", respectively.

Figure 1A:
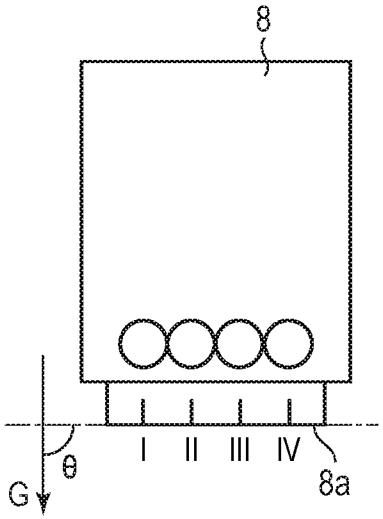
FIG. 1A, which is a view illustrating a relationship between an ejection orifice surface of a recording head and the direction of gravity, is a view illustrating a case in which an angle formed between the ejection orifice surface of the recording head and the direction of gravity is 90°.
Figure 1B:
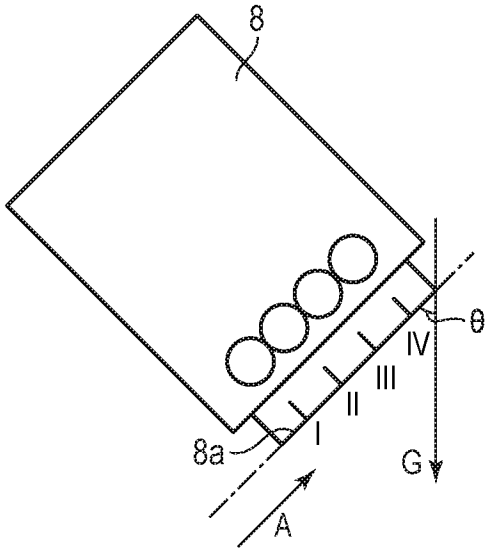
FIG. 1B, which is a view illustrating a relationship between the ejection orifice surface of the recording head and the direction of gravity, is a view illustrating a case in which the angle formed between the ejection orifice surface of the recording head and the direction of gravity is about 45°.
Figure 1C:
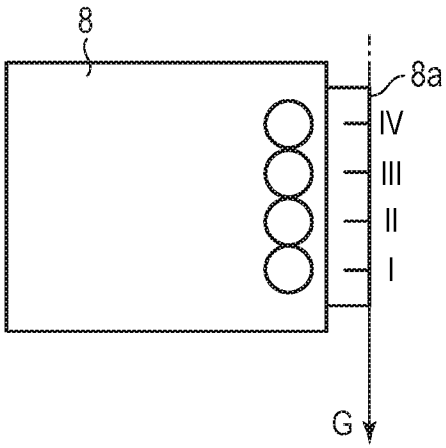
FIG. 1C, which is a view illustrating a relationship between the ejection orifice surface of the recording head and the direction of gravity, is a view illustrating a case in which the angle formed between the ejection orifice surface of the recording head and the direction of gravity is 0°.

FIGS. 1A to 1C are views illustrating a relationship between an ejection orifice surface of a recording head and the direction of gravity, wherein FIG. 1A is a view illustrating a case in which an angle formed between the ejection orifice surface of the recording head and the direction of gravity is 90°, FIG. 1B is a view illustrating a case in which the angle formed between the ejection orifice surface of the recording head and the direction of gravity is about 45°, and FIG. 1C is a view illustrating a case in which the angle formed between the ejection orifice surface of the recording head and the direction of gravity is 0°. In FIGS. 1A to 1C, 8 represents the angle formed between an ejection orifice surface 8*a* of a recording head 8 and the direction of gravity (arrow G in FIGS. 1A to 1C). In a general ink jet recording method, as illustrated in FIG. 1A, ink is ejected from a recording head 8 having the ejection orifice surface 8*a* at an angle of 90° with respect to the direction of gravity, that is, the ejection orifice surface 8*a* is substantially perpendicular to the direction of gravity, such that an image is recorded. However, in an ink jet recording method according to the present invention, ink is ejected from a recording head 8 disposed so that an ejection orifice surface 8*a* of the recording head 8 is at an angle of 0° or more to less than 90° with respect to the direction of gravity, that is, the ejection orifice surface 8*a* is inclined with respect to the direction of gravity, such that an image is recorded. As illustrated in FIG. 1C, the ejection orifice surface 8*a* of the recording head 8 may be at an angle of 0° with respect to the direction of gravity, that is, the ejection orifice surface 8*a* may be approximately parallel with the direction of gravity.

It was found that in the case of repeatedly removing ink adhered to the ejection orifice surface inclined with respect to the direction of gravity and having a plurality of ejection orifice arrays for ejecting a plurality of inks using a cleaning member and recording the image, color mixing occurred in an image to be recorded later. The reason is as follows.

When an image is recorded, in addition to a main ink droplet, small accompanying ink droplets (hereinafter, referred to as "mist") increase, and the mist tends to adhere to a periphery of an ejection orifice. For this reason, ink to be ejected next is pulled by the ink adhered to the periphery of the ejection orifice, such that irregular ejection may occur. Therefore, there is a need to remove the ink adhered to the periphery of the ejection orifice using the cleaning member.

When the ink contains a pigment, as a liquid component in the mist adhered to the periphery of the ejection orifice evaporates, the pigment is aggregated in the periphery of the ejection orifice. In the case of cleaning the ejection orifice surface for removing the aggregated pigment, the pigment aggregated by the cleaning member scrapes the ejection orifice surface like an abrasive, so that unevenness is likely to occur in the periphery of the ejection orifice. Since the unevenness is more likely to occur in the periphery of the ejection orifice in the case of repeating ejection and cleaning of the ink, the ink tends to adhere to the periphery of the ejection orifice.

The phenomenon that ink tends to adhere to the periphery of the ejection orifice is a phenomenon which occurs also in a general ink jet recording method in which an image is recorded by ejecting ink from a recording head 8 disposed so that an ejection orifice surface 8*a* is perpendicular to the direction of gravity. In this case, color mixing of the ink did not occur. The color mixing of the ink is a problem occurring when an image is recorded using a recording head 8 in which an ejection orifice surface 8*a* of the recording head is inclined with respect to the direction of gravity.

Here, as an example, a description is provided based on adjacent ejection orifice arrays I and II of a recording head 8 having an ejection orifice surface 8*a* in which four ejection orifice arrays I to IV are formed as illustrated in FIG. 1B. An ejection orifice group forming each of the ejection orifice arrays is disposed to be substantially orthogonal to a conveying direction (an arrow A in FIG. 1B) of a recording medium. The recording medium is conveyed in an arrow A direction, and ink is ejected onto the recording medium in a sequence of the ejection orifice array I and II.

When an image is recorded using a recording head 8 in which an ejection orifice surface 8*a* is inclined with respect to the direction of gravity, in the peripheries of the ejection orifices constituting the ejection orifice array II, force is applied to ink adhered in a direction of the ejection orifice array I in the direction of gravity. Therefore, in the peripheries of the ejection orifices constituting the ejection orifice array II, the ink tends to accumulate in the direction of the ejection orifice array I. In the case of continuously recording the image, the ink further accumulates in the direction of the ejection orifice array I in the peripheries of the ejection orifices constituting the ejection orifice array II. In addition, an ink meniscus formed at the ejection orifice of the ejection orifice array II is destroyed, whereby the ink overflows, and the ink ejected from the ejection orifice array II flows along the ejection orifice surface to thereby enter the ejection orifice array I. As a result, color mixing occurs in the ink ejected from the ejection orifice array I, such that color mixing occurs in the recorded image.

Further, in a recording head in which the ejection orifice arrays I and II are arranged to at least partially overlap each other in the conveying direction of the recording medium, the ink ejected from the ejection orifice array II tends to enter the ejection orifice array I. As a result, color mixing occurs in the ink ejected from the ejection orifice array I, such that color mixing occurs in the recorded image.

In order to suppress color mixing in the image, the present inventors focused on a relationship between amounts of the resin in the inks ejected from two adjacent ejection orifice arrays. In the case of disposing an ejection orifice array for ejecting ink with a large content of the resin at an upper side in the direction of gravity, even if the liquid component in the mist adhered to the periphery of the ejection orifice array at the upper side evaporates, the resin is present around the pigment. For this reason, aggregation of the pigment is suppressed. Even in the case of cleaning the ejection orifice surface, since scraping of the ejection orifice surface by the aggregated pigment is less likely to occur, unevenness is less likely to occur in the periphery of the ejection orifice, and it is hard for the ink to adhere to the periphery of the ejection orifice. Therefore, since the ink is unlikely to enter the ejection orifice array at a lower side in the direction of gravity, color mixing of the ink is less likely to occur, such that color mixing in the image to be recorded can also be suppressed. Meanwhile, in the case of disposing an ejection orifice array for ejecting ink with a small content of the resin at the upper side in the direction of gravity, when the liquid component in the mist adhered to the periphery of the ejection orifice array at the upper side evaporates, the resin is hardly present around the pigment. For this reason, aggregation of the pigment is promoted. Even in the case of cleaning the ejection orifice surface, since scraping of the ejection orifice surface by the aggregated pigment easily occurs, unevenness easily occurs in the periphery of the ejection orifice, and the ink easily adheres to the periphery of the ejection orifice. Therefore, since the ink easily enters the ejection orifice array at the lower side, color mixing of the ink becomes severe, such that it is impossible to suppress color mixing in the image to be recorded. In other words, the color mixing in the image can be suppressed by disposing the ejection orifice array for ejecting the ink with a relatively large content of the resin at the upper side in the direction of gravity.

<Ink Jet Recording Method>

In the recording head used in the present invention, first ejection orifice array for ejecting first ink and second ejection orifice array for ejecting second ink, respectively, are sequentially arranged from the bottom in the direction of gravity to be adjacent to each other. In addition, a content of the resin in the second ink is larger than that in the first ink. Even in the case in which the recording head includes a plurality of ejection orifice arrays (third and fourth ejection orifice arrays), it is preferable that the relationship between the contents of the resin in the inks ejected from adjacent ejection orifice arrays is satisfied. In this way, color mixing in the image can be suppressed.

Further, colors of the first and second inks may be the different from or the same as each other. When the colors of the first and second inks are different from each other, color mixing in the image to be recorded is easily noticed, but even in this case, color mixing in the image can be suppressed by adopting a configuration according to the present invention. The colors of the first and second inks can be selected from black, cyan, magenta, yellow, and the like, respectively. In the case of different colors, the first and second inks are preferably combinations of two inks selected from the group consisting of black, cyan, magenta, and yellow inks. In the case of the same color, the first and second inks are related to a dark ink and a light ink. The combination of the first and second inks is preferably one selected from the group consisting of a combination of a dark ink having a black color (black ink) and a light ink having the black color (grey ink), a combination of a dark ink having a cyan color (cyan ink) and a light ink having the cyan color (light cyan ink), and a combination of a dark ink having a magenta color (magenta ink) and a light ink having the magenta color (light magenta ink).

<Ink Jet Recording Apparatus>

Hereinafter, in FIGS. 2A to 4B, an X direction refers to a horizontal direction, a Y direction refers to a depth direction of an ink jet recording apparatus, and a Z direction refers to a vertical direction.

Figure 2A:
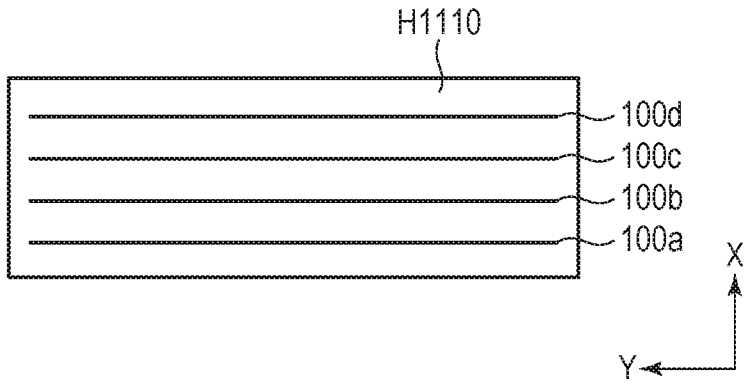
FIG. 2A, which is a view for explaining an example of the recording head, is a schematic view of a recording element substrate.
Figure 2B:
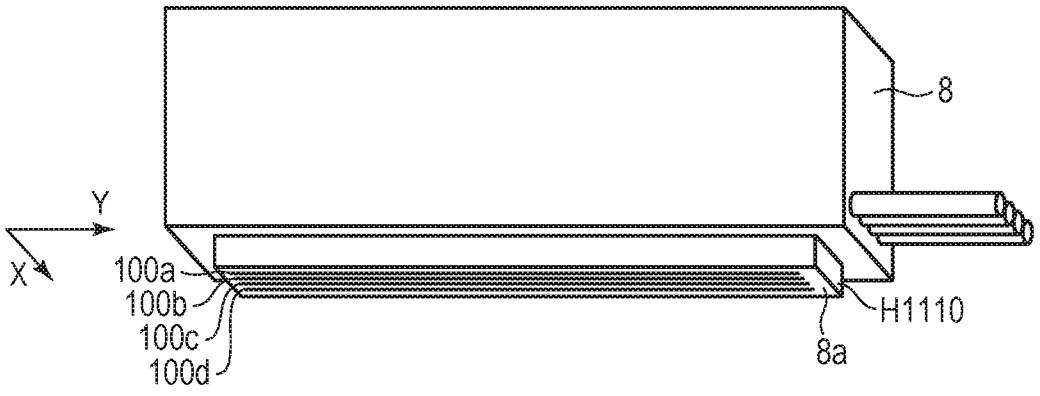
FIG. 2B, which is a view for explaining an example of the recording head, is a perspective view of the recording head.

FIGS. 2A and 2B are views for explaining an example of a recording head, wherein FIG. 2A is a schematic view of a recording element substrate and FIG. 2B is a perspective view of the recording head. The recording head 8 has an ejection orifice surface 8*a* in which a plurality of ejection orifice arrays for ejecting a plurality of inks are formed. Particularly, it is preferable to use a recording head including a single recording element substrate H1110 in which the plurality of ejection orifice arrays 100*a* to 100*d* are arranged as illustrated in FIGS. 2A and 2B. FIG. 2A illustrates a recording element substrate H1110 having four ejection orifice arrays (100*a* to 100*d*) arranged in the Y direction. The ejection orifice surface 8*a* of the recording head 8 is a surface provided with the recording element substrate H1110 having the ejection orifice arrays 100*a* to 100*d*. The recording element substrate H1110 may have the plurality of ejection orifice arrays. For example, in the case in which a single recording element substrate H1110 has four election orifice arrays 100*a* to 100*d*, four kinds of inks such as cyan, magenta, yellow, and black (CMYK) inks are ejected from four ejection orifice arrays 100*a* to 100*d*.

A distance (mm) between an ejection orifice array composed of ejection orifices ejecting one kind of ink and an ejection orifice array composed of ejection orifices ejecting another kind of ink is preferably 0.1 mm or more to 1.5 mm or less and more preferably, 0.1 mm or more to 1.0 mm or less. Further, more preferably, the distance is 0.3 mm or more to 1.0 mm or less. Here, the distance between the ejection orifice arrays is a distance between a straight line connecting the center of each ejection orifice ejecting one kind of ink and a straight line connecting the center of each ejection orifice ejecting another kind of ink. In the case in which there are a plurality of ejection orifice arrays for ejecting one kind of ink, the distance between an ejection orifice array composed of ejection orifices ejecting one kind of ink and an ejection orifice array composed of ejection orifices ejecting another kind of ink. The ejection arrays are spaced at the nearest distance in the X direction.

When the distance between the ejection orifice arrays is short, since the ejection orifice arrays are densely arranged, a higher quality image can be recorded, but since color mixing of the ink from the ejection orifice to another ejection orifice easily occurs, a problem such as color mixing in the image to be recorded significantly occurs. Even in this case, it is possible to suppress color mixing in the image by adopting the configuration according to the present invention.

A long diameter (μm) passing through the center of the ejection orifice 8 of the recording head is preferably 10 μm or more to 50 μm or less. Further, an ejection amount (ng) of the one ink droplet ejected from the recording head 8 is preferably 8.0 ng or less. When the ejection amount is more than 8.0 ng, since at the time of ejecting the ink, the ink easily overflows and thus the mist is easily increased, the ink more easily adheres to the periphery of the ejection orifice. Therefore, color mixing of the ink may easily occur, such that color mixing in the image may not be sufficiently suppressed. When the ejection amount (ng) is preferably 2.0 ng or more.

FIG. 2B illustrates a recording head 8 including one recording element substrate H1110. The recording head 8 may include one recording element substrate H1110 or may also include a plurality of recording element substrates H1110. In the case of using the recording head including the plurality of recording element substrates H1110, a recording head in which a plurality of recording element substrates H1110 are arranged so as to correspond a width of the recording medium in the Y direction in FIGS. 2A and 2B, that is, a line head is preferably used. In the case of using the recording head including the plurality of recording element substrates H1110, it is preferable to arrange the plurality of recording element substrates so that the ejection orifices overlap each other in the conveying direction of the recording medium. In this way, it is possible to suppress black streaks and white voids in connection portions between the recording element substrates H1110. However, since the ejection orifices overlap each other, color mixing of the ink from the ejection orifice to another ejection orifice easily occurs, and thus the problem such as color mixing in the image to be recorded significantly occurs. Even in this case, it is possible to suppress color mixing in the image by adopting the configuration according to the present invention.

Figure 3A:
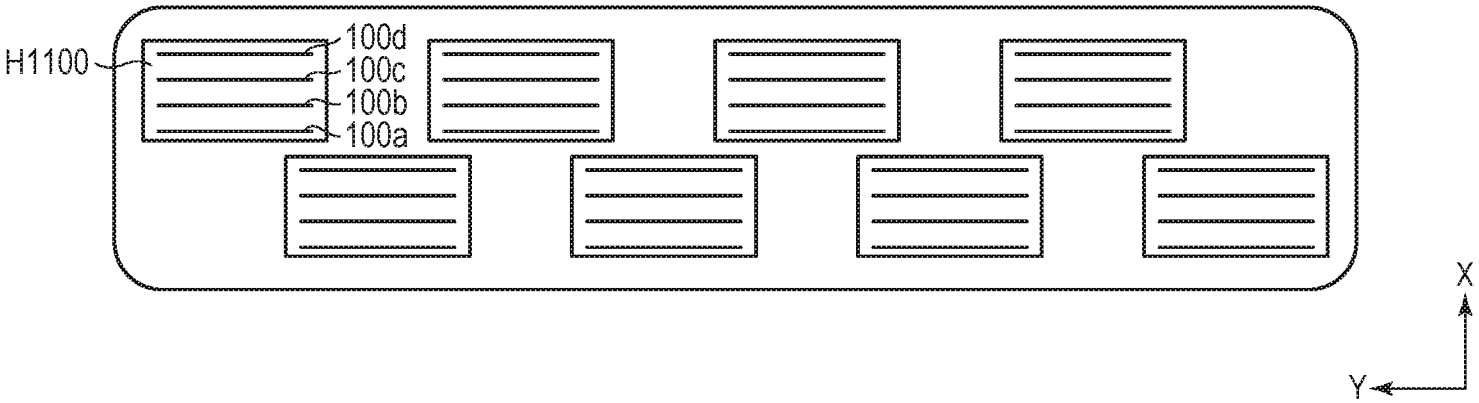
FIG. 3A, which is a view schematically illustrating an example of a line head, is a schematic view of a line head in which the recording element substrates are arranged in a zigzag shape (non-adjacent arrangement) in an arrangement direction of a plurality of ejection orifice arrays.
Figure 3B:
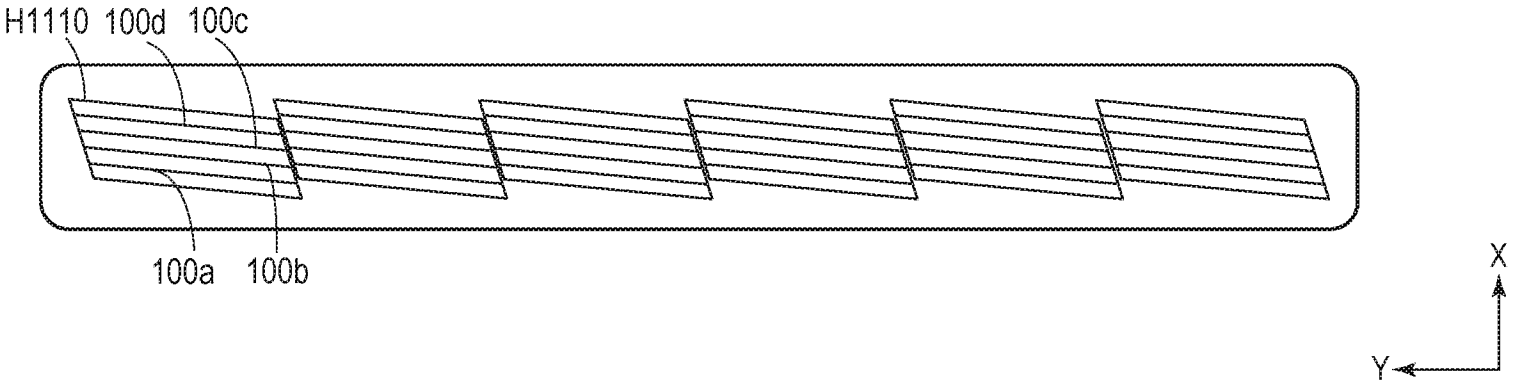
FIG. 3B, which is a view schematically illustrating an example of a line head, is a schematic view of a line head in which the recording element substrates are arranged in a linear shape (adjacent arrangement) in an arrangement direction of a plurality of ejection orifice arrays.

FIGS. 3A and 3B are schematic views of line heads, wherein FIG. 3A is a schematic view of a line head in which the recording element substrates H1110 are arranged in a zigzag shape (non-adjacent arrangement) in an arrangement direction of a plurality of ejection orifice arrays. FIG. 3B is a schematic view of a line head in which recording element substrates H1110 are arranged in a linear shape (adjacent arrangement) in an arrangement direction of a plurality of ejection orifice arrays. In FIGS. 3A and 3B, a plurality of recording element substrates H1110 are arranged on a support substrate, respectively. In view of miniaturization of the apparatus, it is preferable to use a line head in which a plurality of recording element substrates H1110 are arranged to be adjacent in an arrangement direction of the first ejection orifice array and the second ejection orifice array in order to suppress an increase in a length of the line head in the X direction in FIGS. 3A and 3B. In other words, it is preferable to use a line head in which a plurality of recording element substrates H1110 are arranged in a linear shape. Further, an example of a shape of the recording element substrate includes a parallelogram, a rectangle, a trapezoid, and other shapes, but the parallelogram is preferable.

As a method of ejecting the ink, a method of applying mechanical energy to the ink, a method of applying heat energy to the ink, and the like, can be used. Among them, as the method of ejecting the ink, the method of applying heat energy to the ink is preferably used.

Figure 4B:
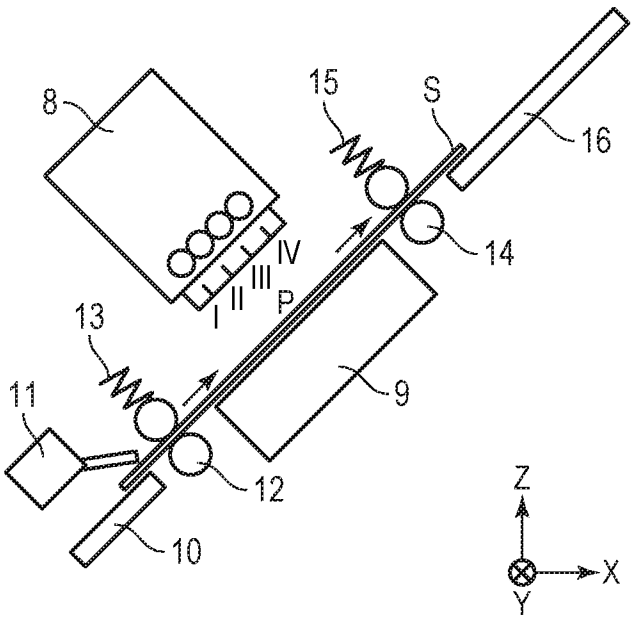
FIG. 4B, which is a view schematically illustrating an example of the ink jet recording apparatus, is an enlarged view of a portion around the recording head.
Figure 4A:
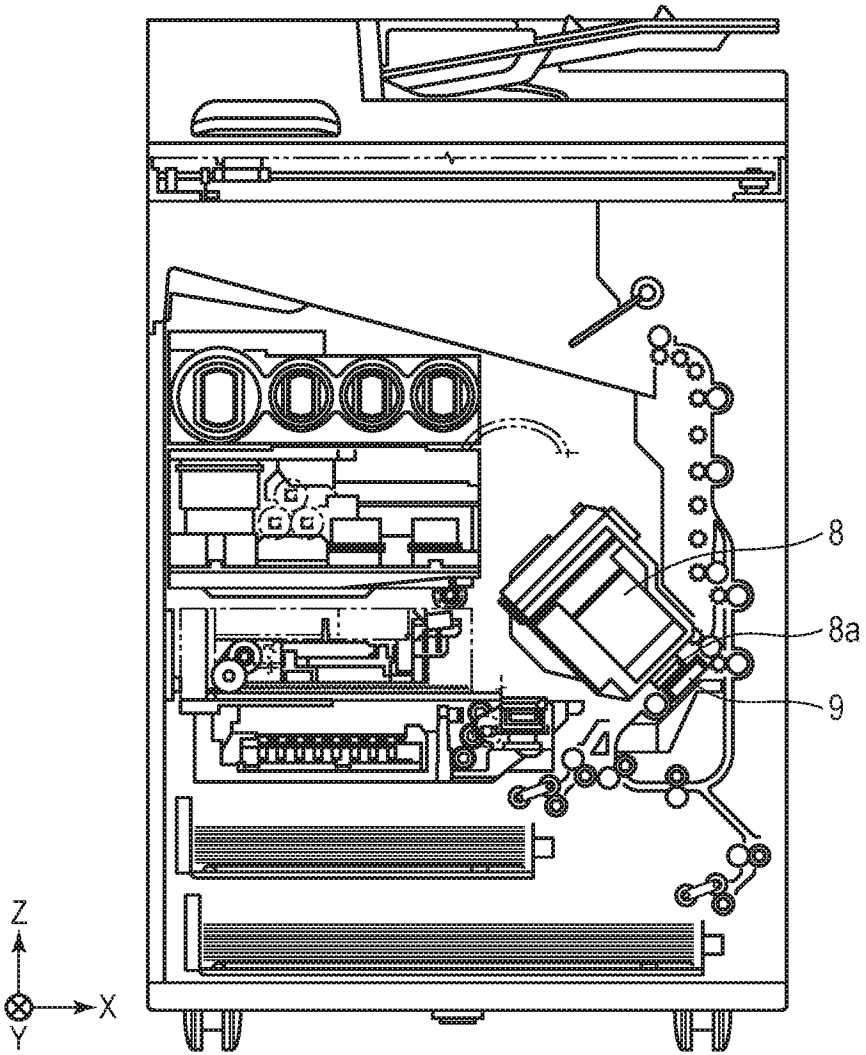
FIG. 4A, which is a view schematically illustrating an example of an ink jet recording apparatus, is a cross-sectional view of an entire apparatus.

FIGS. 4A and 4B are views schematically illustrating an example of an ink jet recording apparatus, wherein FIG. 4A is a cross-sectional view of an entire apparatus, and FIG. 4B is an enlarged view of a portion around the recording head. As illustrated in FIGS. 4A and 4B, in order to miniaturize the apparatus, it is preferable to use an ink jet recording apparatus capable of recording an image by a single recording head 8 capable of ejecting a plurality of inks instead of a plurality of recording heads corresponding to the plurality of inks. At the time of ejecting the ink to record an image, as illustrated in FIGS. 4A and 4B, an angle formed between an ejection orifice surface 8*a* of the recording head 8 and the direction of gravity is 0° or more to less than 90° and the ink is ejected from a recording head 8 inclined with respect to the direction of gravity, such that the image is recorded.

In addition, at the time of ejecting the ink to record the image, a difference between an angle formed between a recording medium S and the direction of gravity and the angle formed between the ejection orifice surface 8*a* of the recording head 8 and the direction of gravity is preferably ±5° or less and more preferably 0°. That is, a difference between a distance between ejection orifices forming an ejection orifice array I and the recording medium S and a distance between ejection orifices forming an ejection orifice array IV and the recording medium S is preferably ±1 mm or less and more preferably 0 mm. Here, the distance between the ejection orifice and the recording medium S is a distance between the center of the ejection orifice and a position at which a line intersects the recording medium S when the line is extended from the center of the ejection orifice in the direction of gravity. As described above, by setting the conveying direction of the recording medium S at the time of recording an image to the above conditions, a conveying distance of the recording medium S in the X direction is also shortened, thereby making it possible to miniaturize the apparatus. In order to shorten the conveying distance of the recording medium S in the X direction, the angle formed between the ejection orifice surface of the recording head and the direction of gravity is 10° or more to 80° or less, and more preferably 30° or more to 60° or less.

The ejection orifice surface 8*a* of the recording head 8 faces a platen 9. In FIGS. 4A and 4B, a plane of the platen 9 is inclined at about 45° with respect to the direction of gravity, and the ejection orifice surface 8*a* of the recording head 8 is also inclined at about 45° with respect to the direction of gravity so that a distance from the platen 9 is constantly maintained. When the ink jet recording apparatus does not perform a recording operation, the angle formed between the ejection orifice surface 8*a* of the recording head 8 and the direction of gravity is 90°.

Further, a conveyance path of the recording medium S at the time of recording an image is described. In FIG. 4B, the recording medium S is guided by a first guide 10, and a tip position of the recording medium S is detected by a paper sensor 11. The recording medium S is conveyed toward a recording region P between the recording head 8 and the platen 9 while being sandwiched between a first conveying roller 12 and a first pinch roller 13 composed of a spur energized by a spring and the like. In the recording region P, the ink is ejected from the plurality of ejection orifice arrays I to IV in the recording head 8 to the recording medium S. A rear surface of the recording medium S in the region to which the ink is applied is supported by the platen 9, and the distance between the ejection orifice surface 8*a* and the recording medium S is constantly maintained. After the ink is applied, the recording medium S is guided by a second guide 16 while being sandwiched between a second conveying roller 14 and a second pinch roller 15, such that the recording medium S is conveyed. The conveying direction of the recording medium S at the time of recording the image may be opposite to a direction illustrated in FIG. 4B, but it is preferable that the conveying direction is the same direction as the direction illustrated in FIG. 4B. That is, it is preferable that a first ejection orifice array (ejection orifice array I) disposed at an upstream side in the conveying direction of the recording medium S is disposed at the lower side in the direction of gravity than a second ejection orifice array (ejection orifice array II) disposed at a downstream side in the conveying direction of the recording medium S. In addition, it is preferable that the conveying direction of the recording medium at the time of recording the image is a direction intersecting an arrangement direction of the ejection orifice arrays I to IV.

Figure 5:
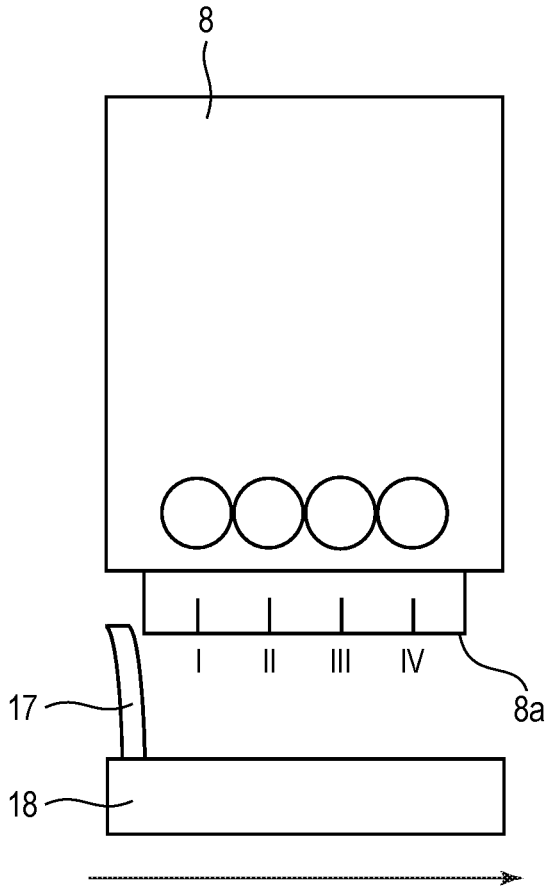
FIG. 5 is a cross-sectional view schematically illustrating an example of a cleaning device.

FIG. 5 is a cross-sectional view schematically illustrating an example of a cleaning device. The cleaning device includes a wiper which is a member for cleaning the ejection orifice surface 8*a* of the recording head 8. A wiper 17 formed of an elastic member such as rubber or the like is fixed to a wiper holder 18, and the wiper holder 18 can be moved in right and left directions of FIG. 5 (direction intersecting the arrangement direction of the ejection orifice array I to IV of the recording head). As illustrated in FIG. 5, in the case of cleaning the ejection orifice surface in the direction intersecting the ejection orifice arrays I to IV of the recording head, since the recording heads are inclined with respect to the direction of gravity, scraping of the ejection orifice surface by the pigment easily occurs in the direction of gravity. Therefore, since color mixing of the ink from the ejection orifice to another ejection orifice easily occurs, the problem such as color mixing in the image to be recorded significantly occurs. Even in this case, it is possible to suppress color mixing in the image by adopting the configuration according to the present invention.

A home position is a position where the recording head is waiting when no image is recorded. When the ejection orifice surface 8*a* is cleaned, after moving the recording head 8 to the home position, the wiper holder 18 is moved in an arrow direction in FIG. 5. Here, the wiper 17 may be significantly bent so that a side portion thereof comes in contact with the ejection orifice surface 8*a* at the time of slide-contacting the ejection orifice surface 8*a* of the recording head 8, and may be slightly bent so that a tip portion thereof comes into contact with the ejection orifice surface 8*a* of the recording head 8. As illustrated in FIG. 5, as the cleaning device, a device wiping the ejection orifice surface with a wiper or the like, or a device pressing a cloth or a porous member against the ejection orifice surface to clean the ejection orifice surface can be used. Among them, the device wiping the ejection orifice surface with the wiper or the like is preferably used. It is preferable that this cleaning operation is performed at least after the condition at which the ink adheres to the ejection orifice surface is made. For example, the cleaning operation can be performed at a timing after a suction-recovery operation for removing clogging of the ejection orifice or a timing after recording the image.

In order to suppress a variation in the ejection amount of the ink, it is preferable to preheat the ink before ejecting the ink based on image data. This preheating is an operation of heating the ink using a heating element present in the vicinity of the recording element for ejecting the ink. Since a viscosity of the ink is easily lowered by heating the ink, the ink ejected from the ejection orifice is likely to flow along the ejection orifice surface, and color mixing of the ink easily occurs. Therefore, the problem such as color mixing in the image to be recorded significantly occurs. Even in this case, it is possible to suppress color mixing in the image by adopting the configuration according to the present invention.

Further, it is preferable that the ejection orifice surface 8*a* of the recording head 8 is subjected to water-repellent treatment. In this way, since a contact angle between the ink adhered to the periphery of the ejection orifice surface 8*a* and the ejection orifice surface is increased, the ink droplets easily become granular. Therefore, it is hard for the ink to flow along the ejection orifice surface 8*a* in the direction of gravity and color mixing in the image can be further suppressed.

As a method of performing water-repellent treatment on the ejection orifice surface, a method of applying a water-repellent material with a spray, a method of adhering a water-repellent material by vacuum deposition or plasma polymerization, and the like can be selected. Water-repellency of the formed ejection orifice surface can be determined by measuring a contact angle of a water droplet on a surface of the member. When the contact angle of the water droplet is 70° or more, the member can be said to have water-repellency, and it is preferable that the contact angle of the water droplet is 90° or more. Further, the contact angle of the water droplet can be measured using pure water (ion exchange water) and a general contact angle meter. As an example of the contact angle meter, an automatic contact angle measuring device (CA-W, Kyowa Interface Science Co., Ltd.) can be used.

As an example of the water-repellent material, a fluororesin based compound is preferably used. Particularly, it is preferable that a water-repellent surface is formed as a uniform resin film made of the fluororesin based compound, and it is preferable that the resin film does not contain a metal such as nickel or the like. Examples of the fluororesin based compound include a polytetrafluoroethylene resin, a fluororesin having a cyclic structure, and the like. Specific examples thereof can include Polyflon PTFE (manufactured by Daikin Industries, Ltd), Teflon (registered trademark) PTFE (manufactured by DuPont), Cytop (manufactured by AGC Inc.), and the like. In addition, other fluorine atom-containing resins such as fluorinated epoxy resins, fluorinated polyimide resins, fluorinated polyamide resins, fluorinated acrylic resins, fluorinated urethane resins, fluorinated siloxane resins, modified resins thereof, and the like can also be used. Further, as the water-repellent material, compounds containing a silicon atom or silicone based resins may be used.

Particularly, in view of obtaining high water-repellency and durability, as the water-repellent material, it is preferable to use a hydrolyzable silane compound having a fluoroalkyl group and a condensate of a hydrolyzable silane compound having a cationic polymerizable group. Further, a resin obtained by curing the condensate by irradiation with an active energy ray such as ultraviolet ray or the like may also be used. These hydrolyzable silane compounds have a hydrolyzable group in their molecular structure. An example of the hydrolyzable group can include an alkoxy group. Further, examples of the cationic polymerizable group can include a cyclic ether group, a cyclic vinyl ether group, and the like.

The ink jet recording apparatus may include a unit applying a reaction liquid containing a reaction agent for aggregating a coloring material in the ink onto the recording medium. Examples of the unit applying the reaction liquid onto the recording medium include a unit applying the reaction liquid onto the recording medium with a roller or the like, a unit ejecting the reaction liquid from an ink jet type recording head, and the like. The ink jet recording apparatus according to the present invention does not have to include an irradiation unit of an energy ray.

<Ink>

Hereinafter, each component constituting the ink used in the present invention is described in detail. The inks used in the present invention may not contain compounds polymerized by irradiation with an energy ray.

(Pigment)

The ink contains a pigment. A content (mass %) of the pigment in the ink is preferably 0.1 mass % or more to 15.0 mass % or less and more preferably 1.0 mass % or more to 11.0 mass % or less based on a total mass of the ink.

As a dispersion method of the pigment, a resin-dispersed pigment using a resin as a dispersant, a self-dispersible pigment in which a hydrophilic group is bonded to a particle surface of the pigment, and the like can be used. Further, a resin-bonded pigment in which an organic group containing a resin is chemically bonded to a particle surface of the pigment and a microcapsule pigment in which a particle surface of the pigment is coated with a resin or the like can also be used. It is possible to use pigments of which dispersion methods are different from each other in combination.

Specific examples of the pigment can include inorganic pigments such as carbon black and titanium oxide; and organic pigments such as azo, phthalocyanine, quinacridone, isoindolinone, imidazolone, diketopyrrolopyrrole, dioxazine, and the like.

It is preferable that among two adjacent ejection orifice arrays, an ejection orifice array for ejecting the ink containing carbon black is positioned at the lower side in the direction of gravity. Carbon black has a developed structure as compared to other pigments. For this reason, when aggregated carbon black adheres to the periphery of the ejection orifice, unevenness is likely to occur in the periphery of the ejection orifice and ink easily adheres thereto. When between two adjacent ejection orifice arrays, an ejection orifice array for ejecting the ink containing carbon black is disposed at the upper side in the direction of gravity, the ink enters the ejection orifice array at the lower side in the direction of gravity and color mixing of the ink is further increased. Therefore, in some cases, color mixing in the image cannot be sufficiently suppressed. For this reason, between two adjacent ejection orifice arrays, the ejection orifice array for ejecting the ink containing carbon black is disposed at the lower side in the direction of gravity, such that even though the ink flows along the ejection orifice surface, the ink is less likely to enter another ejection orifice array. This makes color mixing of the ink difficult, such that color mixing in the image can be suppressed. It is more preferable that the ejection orifice array for ejecting the ink containing carbon black is positioned at the lowermost side in the direction of gravity.

(Resin)

At least one kind of ink among the plurality of inks ejected from respective ejection orifice arrays I to IV (first to fourth ejection orifice arrays) contains a resin. Further, it is preferable that each ink of the plurality of inks contains the resin. In this way, since it is possible to suppress aggregation of the pigment in the periphery of any ejection orifice, color mixing of the ink is less likely to occur, such that color mixing in the image can be further suppressed.

The resin can be added for reasons such as (i) stabilizing a dispersion state of the pigment, that is, as a resin dispersant or a dispersion aid, (ii) improving various properties of the image to be recorded, and the like. As a form of the resin there are a block copolymer, a random copolymer, a graft copolymer, a combination of these copolymers, and the like. Further, the resin may be in a state in which the resin is dissolved in an aqueous medium as a water-soluble resin and may also be in a state in which the resin is dispersed in an aqueous medium as resin particles. The resin particles do not have to contain a coloring material. Particularly, it is preferable that the resin is the water-soluble resin.

In the present invention, the resin is water-soluble, which means that the resin does not form particles of which a diameter can be measured by a dynamic light scattering method when the resin is neutralized with an alkali in an amount equivalent to an acid value of the resin. Whether or not the resin is water soluble can be determined by a method described below. First, a liquid (resin solid content: 10 mass %) containing a resin neutralized by alkali (sodium hydroxide, potassium hydroxide, or the like) equivalent to an acid value is prepared. Next, the prepared liquid is diluted 10 times with pure water (based on volume), thereby preparing a sample solution. Then, when a particle having a particle diameter is not measured in the case of measuring a particle diameter of the resin in the sample solution by the dynamic light scattering method, it can be determined that the resin is water soluble. In this case, for example, measurement conditions can be set as follows: SetZero: 30 seconds, measurement frequency: 3 times, and measurement time: 180 seconds. As a particle size distribution analyzer, a particle size analyzer (for example, "UPA-EX150", manufactured by Nikkiso Co., Ltd.) using the dynamic light scattering method, or the like, can be used. However, the used particle size distribution analyzer or measurement conditions are not limited thereto.

Examples of the resin include an acrylic resin, a urethane resin, an olefin resin, and the like. Among them, it is preferable that the resin is the acrylic resin.

As the acrylic resin, an acrylic resin having a hydrophilic unit and a hydrophobic unit as constituent units is preferable. Among them, a resin having a hydrophilic unit derived from (meth)acrylic acid and a hydrophobic unit derived from a monomer of at least one of styrene and α-methylstyrene is preferable. Since these resins easily interact with pigments, these resins can be appropriately used as resin dispersants for dispersing the pigments.

The hydrophilic unit is a unit having a hydrophilic group such as an anionic group or the like. The hydrophilic unit can be formed by polymerizing, for example, a hydrophilic monomer having a hydrophilic group. Specific examples of the hydrophilic monomer having a hydrophilic group can include acidic monomers having a carboxylic acid group such as (meth)acrylic acid, itaconic acid, maleic acid, fumaric acid, or the like, anionic monomers such as anhydrides or salts of these acid monomers, and the like. Examples of cations constituting the salts of the acidic monomers can include lithium, sodium, potassium, ammonium, and organic ammonium ions and the like. The hydrophobic unit is a unit that does not have the hydrophilic group such as the anionic group or the like. The hydrophobic unit can be formed by polymerizing, for example, a hydrophobic monomer that does not have the hydrophilic group such as the anionic group or the like. Specific examples of the hydrophobic monomer can include monomers having an aromatic ring such as styrene, α-methylstyrene, benzyl (meth)acrylate; (meth)acrylic acid ester based monomers such as methyl (meth)acrylate, butyl (meth)acrylate, 2-ethylhexyl (meth)acrylate, and the like.

The urethane resin can be obtained by reacting, for example, polyisocyanate and polyol with each other. Further, a chain extender may be additionally reacted therewith. Examples of the olefin based resin include polyethylene, polypropylene, and the like.

The resin is preferably used as the resin dispersant for dispersing the pigment. Whether or not the resin is the resin dispersant can be determined by a method described below. First, a liquid obtained by concentrating or diluting the ink so that a solid content in the ink is about 10 mass % is centrifuged at 12,000 rpm for 1 hour. In this way, since the resin that does not contribute to dispersing the pigment is contained in a liquid layer, a sedimentation component containing the pigment is collected. In this case, a resin contained in the sedimentation component containing the pigment as a main component is a resin (resin dispersant) contributing to dispersing the pigment, and a resin contained in the liquid layer as a main component is a resin that does not contribute to dispersing the resin.

A content (mass %) of the resin in the ink is preferably 0.5 mass % or more to 10.0 mass % or less, more preferably 0.5 mass % or more to 8.0 mass % or less, and further more preferably 2.0 mass % or more to 8.0 mass % or less, based on a total mass of the ink. In the case of using the resin dispersant as the resin, a content (mass %) of a coloring material is preferably 2.0 times or more to 10.0 times or less as a mass ratio with respect to a content (mass %) of the resin dispersant.

(First Water-Soluble Organic Solvent)

It is preferable that the ink contains a first water-soluble organic solvent having a relative dielectric constant of 20.0 or more. By suppressing aggregation of the pigment to reduce unevenness of the periphery of the ejection orifice, it is hard for the ink to accumulate in the periphery of the ejection orifice, such that it is hard for the ink to flow along the ejection orifice surface. In this way, color mixing of the ink is suppressed, such that color mixing in the image can be suppressed. The relative dielectric constant of the first water-soluble organic solvent is preferably 40.0 or more, and more preferably 45.0 or less. A vapor pressure of the first water-soluble organic solvent at a temperature of 25° C. is preferably lower than that of water.

A relative dielectric constant of a water-soluble organic solvent can be measured at 10 kHz using a dielectric constant meter (for example, BI-870 manufactured by Brookhaven Instruments Corp. or the like). The relative dielectric constant $\varepsilon_{sol}$ of a water-soluble organic solvent in a solid state at a temperature of 25° C. can be calculated according to the following Equation (1) by measuring a relative dielectric constant 850% of a 50.0 mass % aqueous solution.

$$\varepsilon_{sol}=2\varepsilon_{50\%}-\varepsilon_{water} \quad \text{Equation (1)}$$

$\varepsilon_{sol}$: relative dielectric constant of the water-soluble organic solvent in a solid state at a temperature of 25° C.

$\varepsilon_{50\%}$: relative dielectric constant of 50.0 mass % aqueous solution of the water-soluble organic solvent in the solid state at a temperature of 25° C.

$\varepsilon_{water}$: relative dielectric constant of water

The reason for calculating the relative dielectric constant $\varepsilon_{sol}$ of the water-soluble organic solvent in the solid state at a temperature of 25° C. from the relative dielectric constant 650% of the 50.0 mass % aqueous solution is as follows. It may be difficult to prepare a high-concentration aqueous solution with a concentration exceeding 50.0 mass % from a water-soluble organic solvent capable of being a constituent component of the ink among water-soluble organic solvents in the solid state at a temperature of 25° C. Meanwhile, the relative dielectric constant $\varepsilon_{water}$ of water is dominant in a low-concentration aqueous solution with a concentration of 10.0 mass % or less, such that it is difficult to obtain a value of a probable (effective) relative dielectric constant of a water-soluble organic solvent. Therefore, as a result of the study by the present inventors, it was found that aqueous solutions to be measured can be prepared using most of the water-soluble organic solvents in a solid state at a temperature of 25° C. used in the ink, and the calculated relative dielectric constants $\varepsilon_{sol}$ is also consistent with the effect of the present invention. Due to the above-mentioned reason, in the present invention, the relative dielectric constant $\varepsilon_{sol}$ of the water-soluble organic solvent in the solid state at a temperature of 25° C. is calculated from the relative dielectric constant 850% of the 50.0 mass % aqueous solution to thereby be used. Even in the case of the water-soluble organic solvent in the solid state at a temperature of 25° C., when solubility in water is low and thus it is impossible to prepare a 50.0 mass % aqueous solution, an aqueous solution with a saturated concentration is used, and a value of the relative dielectric constant $\varepsilon_{sol}$ calculated in accordance with the case of calculating is used for convenience.

Specific examples of the first water-soluble organic solvent include monohydric alcohols having 1 to 4 carbon atoms such as methyl alcohol (33.1) and ethyl alcohol (23.8); dihydric alcohols such as 1,2-propanediol (28.8), 1,3-butanediol (30.0), 1,4-butanediol (31.1), 1,5-pentanediol (27.0), and 3-methyl-1,5-pentanediol (23.9); polyhydric alcohols such as 1,2,6-hexanetriol (28.5), glycerin (42.3), and trimethylolpropane (33.7); alkylene glycols such as ethylene glycol (40.4), diethylene glycol (31.7), triethylene glycol (22.7), and tetraethylene glycol (20.8); nitrogen-containing compounds such as 2-pyrrolidone (28.8), N-methyl-2-pyrrolidone (32.0), urea (110.3), ethyleneurea (49.7), and triethanolamine (31.9); and sulfur-containing compounds such as dimethylsulfoxide (48.9).

A content (mass %) of the first water-soluble organic solvent is preferably 1.5 times or more as a mass ratio (times) with respect to the content (mass %) of the pigment. When the ratio is 1.5 times or more, since the content of the first water-soluble organic solvent is higher than that of the pigment, aggregation of the pigment can be suppressed. Even though the ejection orifice surface is cleaned, the ejection orifice surface is hardly scraped by the pigment. This makes color mixing of the ink difficult, such that color mixing in an image to be recorded later can be further suppressed. It is preferable that the ratio is 10.0 times or less. Further, a content (mass %) of the first water-soluble organic solvent in the ink with a large content of the resin is preferably 2.5 times or more as a mass ratio (times) with respect to a content (mass %) of the pigment in the ink with a large content of the resin. When the ratio is 2.5 times or more, aggregation of the pigment can be further suppressed in the periphery of the ejection orifice disposed at the upper side in the direction of gravity. This makes color mixing of the ink difficult, such that color mixing in an image to be recorded later can be further suppressed. It is preferable that the ratio is 10.0 times or less.

A mass ratio of the content of the resin to the content of the pigment in ink with a large content of the resin is preferably larger than a mass ratio of the content of the resin to the content of the pigment in ink with a small content of the resin. Further, a mass ratio of the content of the first water-soluble organic solvent to the content of the pigment in the ink with a large content of the resin is preferably larger than a mass ratio of the content of the first water-soluble organic solvent to the content of the pigment in the ink with a small content of the resin.

(Aqueous Medium)

The ink can contain water or an aqueous medium which is a mixed medium of water and a water soluble organic solvent. As the water, deionized water or ion exchange water is preferably used. A content (mass %) of water in aqueous ink is 50.0 mass % or more to 95.0 mass % or less based on the total mass of the ink.

As the water-soluble organic solvent, a water-soluble organic solvent (other water-soluble organic solvents) in addition to the first water-soluble organic solvent can be used in combination. Other water-soluble organic solvents are not particularly limited as long as they are water-soluble. For example, alcohols, glycols, glycol ethers, nitrogen-containing compounds, and the like can be used. Further, one or two kinds or more of other water-soluble organic solvents can be contained in the ink. A content (mass %) of the water-soluble organic solvent in the ink is 3.0 mass % or more to 50.0 mass % or less based on the total mass of the ink. The content is a value including the content of the first water-soluble organic solvent. The content (mass %) of the first water-soluble organic solvent is preferably 0.4 times or more to 1.0 time or less as a mass ratio (times) with respect to a total content (mass %) of the water-soluble organic solvents. When the ratio is more preferably 0.5 times or more to 1.0 time or less and further more preferably 0.5 times or more to 0.8 times or less.

Specific examples of the water-soluble organic solvent include the following organic solvents as well as the specific water-soluble organic solvents described above (numerical values in parentheses indicate relative dielectric constant $\varepsilon_{sol}$ at a temperature of 25° C.). Monohydric alcohols having 1 to 4 carbon atoms such as methyl alcohol (33.1), ethyl alcohol (23.8), n-propyl alcohol, isopropyl alcohol (18.3), n-butyl alcohol, sec-butyl alcohol, and tert-butyl alcohol; dihydric alcohols such as 1,2-propanediol (28.8), 1,3-butanediol (30.0), 1,4-butanediol (31.1), 1,5-pentanediol (27.0), 1,2-hexanediol (14.8), 1,6-hexanediol (7.1), 2-methyl-1,3-propanediol, and 3-methyl-1,5-pentanediol (23.9); polyhydric alcohols such as 1,2,6-hexanetriol (28.5), glycerin (42.3), trimethylolpropane (33.7), and trimethylolethane; alkylene glycols such as ethylene glycol (40.4), diethylene glycol (31.7), triethylene glycol (22.7), tetraethylene glycol, butylene glycol, hexylene glycol, and thiodiglycol; glycol ethers such as diethylene glycol monomethyl ether, diethyleneglycol monoethyl ether, triethylene glycol monoethyl ether, and triethylene glycol monobutyl ether (9.8); polyalkylene glycols having a number average molecular weight of 200 or more to 1,000 or less such as polyethylene glycol (11.5) having a number average molecular weight of 600, polyethylene glycol (4.6) having a number average molecular weight of 1,000, and polypropylene glycol; nitrogen-containing compounds such as 2-pyrrolidone (28.8), N-methyl-2-pyrrolidone (32.0), 1,3-dimethyl-2-imidazolidinone, N-methylmorpholine, urea (110.3), ethyleneurea (49.7), and triethanolamine (31.9); and sulfur-containing compounds such as dimethylsulfoxide (48.9) and bis(2-hydroxyethylsulfone) are exemplified. As the water-soluble organic solvent to be contained in the ink, a water-soluble organic solvent of which a relative dielectric constant $\varepsilon_{sol}$ is 3.0 or more and a vapor pressure at a temperature of 25° C. is lower than that of water is preferable.

(Other Additives)

If necessary, the ink may contain various additives such as a surfactant, a pH adjusting agent, a defoaming agent, a rust preventing agent, an antiseptic, an antifungal agent, an antioxidant, a reduction inhibitor, a chelating agent, a resin, and the like. Further, in general, since a content of these additives in the ink is significantly small, an influence on the effect of the present invention also is small. For this reason, in the present invention, these additives are not included in the "water-soluble organic solvent" and are not subject to calculation of the relative dielectric constant $\varepsilon_{sol}$. A content (mass %) of the surfactant is preferably 0.1 mass % or more to 5.0 mass % or less and more preferably 0.2 mass % or more to 3.0 mass % or less based on the total mass of the ink. As the surfactant, a non-ionic surfactant is preferably used.

(Physical Properties)

In order to suppress color mixing of the ink, it is important to make it hard for the ink to adhere to the periphery of the ejection orifice at the time of ejecting the ink. Therefore, since a time required from foaming to ejecting the ink is several milliseconds (msec), attention was focused on a dynamic surface tension of the ink at 10 msec as a very short lifetime that can be accurately measured. The dynamic surface tension (mN/m) of the ink at a lifetime of 10 msec is preferably 35 mN/m or more.

When the dynamic surface tension is less than 35 mN/m, it is hard for tension decreasing a surface area to act on a surface of the ink, such that when the ink is ejected, the ink easily adheres to the periphery of the ejection orifice. Therefore, since the ink ejected from the ejection orifice easily flows along the ejection orifice surface 8*a*, color mixing of the ink occurs, such that in some cases, color mixing in the image to be recorded cannot be sufficiently suppressed. The dynamic surface tension is preferably 48 mN/m or less.

The dynamic surface tension of the ink is measured by a maximum foam pressure method. In this method, surface tension is obtained by immersing a probe (thin tube) in a liquid to be measured and measuring a maximum pressure required to release air bubbles pushed out from a tip portion of the probe. Further, the lifetime is a time required to reach the maximum bubble pressure (a radius of curvature of the air bubble and a radius of the tip portion of the probe are equal to each other) after the air bubble is released and a new surface is formed when the air bubble is formed from the tip portion of the probe.

In addition, static surface tension (mN/m) of the ink is preferably 30 mN/m or more to 40 mN/m or less. The static surface tension of the ink is measured by a Wilhelmy balance method (plate method). A value of the surface tension can be appropriately adjusted depending on the kind and an amount of surfactant.

A viscosity of the ink at a temperature of 25° C. is preferably 1.0 mPa·s or more to 15.0 mPa·s or less.

Example

Hereinafter, the present invention will be described in more detail through Examples, Comparative Examples, and Reference Examples, but the present invention is not limited to the following Examples as long as the present invention does not depart from the gist thereof. Unless otherwise specified, the terms "part(s)" and "%" indicating contents are based on mass.

(Pigment Dispersion Liquid 1)

To a solution in which 5.0 g of concentrated hydrochloric acid was dissolved in 5.5 g of water, 1.6 g of 4-amino-1,2-benzene dicarboxylic acid was added at a temperature of 5° C. A solution in which 1.8 g of sodium nitrite was dissolved in 9.0 g of water was added to the solution obtained above while stirring the mixture in an ice bath in order to maintain the temperature to 10° C. or less. After the stirring for 15 minutes, 6.0 g of carbon black having a specific surface area of 220 $m^2/g$ and a DBP oil absorption amount of 105 mL/100 g was added thereto and mixed therewith. Further, after the stirring for 15 minutes, obtained slurry was filtered through filter paper (standard filter paper No. 2, manufactured by Advantech Co., Ltd.), and the carbon black was sufficiently washed with water and dried in an oven at a temperature of 110° C. Water was added to the obtained carbon black, thereby obtaining a pigment dispersion liquid 1 (content of a pigment: 10.0%) in a state in which a self-dispersible pigment having a $—C_6H_3—(COONa)_2$ group bonded to a particle surface of the carbon black was dispersed in water. Thereafter, sodium ions in the pigment dispersion liquid were replaced with potassium ions using an ion exchange method.

(Pigment Dispersion Liquid 2)

First, 12.0 parts of a pigment, 24.0 parts of a liquid containing a resin, and 64.0 parts of ion exchange water were mixed with each other. As the pigment, C.I. pigment blue 15:3 (Hostaperm Blue B2G, manufactured by Clariant)

was used. As the liquid containing a resin, a styrene-acrylic acid copolymer (Joncryl 680, manufactured by BASF) was neutralized with an aqueous solution of potassium hydroxide (0.85 equivalents) based on an acid value of the copolymer, such that a liquid in which a content of the resin was 20.0% was used. The mixture was dispersed for 3 hours while being cooled with water using a batch type vertical sand mill (manufactured by Aimex Co., Ltd.) filled with 85.0 parts of zirconia beads having a particle diameter of 0.3 mm. Thereafter, the dispersion liquid was subjected to centrifugation to remove coarse particles, and pressure-filtration was performed thereon using a cellulose acetate filter (manufactured by Advantech Co., Ltd.) having a pore size of 3.0 μm. A pigment dispersion liquid 2 (content of pigment: 10.0%, content of resin: 4.0%) in a state in which the pigment was dispersed in water by the resin was obtained by the above-mentioned method.

(Pigment Dispersion Liquid 3)

The kind of the pigment was changed to a solid solution (Cromophtal Jet Magenta 2BC, manufactured by Ciba) of C.I. pigment red 202 and C.I. pigment violet 19 in the preparation of the pigment dispersion liquid 2. A pigment dispersion liquid 3 (content of pigment: 10.0%, content of resin: 4.0%) was obtained by a procedure similar to that in the above-mentioned pigment dispersion liquid 2 except for the above-mentioned difference.

(Pigment Dispersion Liquid 4)

The kind of the pigment was changed to C.I. pigment yellow 74 (Hansa yellow 5GXB, manufactured by Clariant) in the preparation of the pigment dispersion liquid 2. A pigment dispersion liquid 4 (content of pigment: 10.0%, content of resin: 4.0%) was obtained by a procedure similar to that in the above-mentioned pigment dispersion liquid 2 except for the above-mentioned difference.

(Pigment Dispersion Liquid 5)

First, 20.0 g of a pigment, 1.6 mmol of a treating agent, 8.0 mmol of nitric acid, and 200.0 mL of water were mixed with each other. As the pigment, C.I. pigment blue 15:3 (Hostaperm Blue B2G, manufactured by Clariant) was used and as the treating agent, p-aminophthalic acid was used. The mixture was mixed at a temperature of 25° C. and 6,000 rpm for 30 minutes using a Silverson mixer. To the obtained mixture, an aqueous solution in which 8.0 mmol of potassium nitrite was dissolved in a small amount of water was slowly added. A temperature of the mixture reached 60° C. by addition of the aqueous solution. The mixture was allowed to react at a temperature of 60° C. for 1 hour. Thereafter, a pH of the mixture was adjusted to 10 using a 1.0 mol/L aqueous solution of potassium hydroxide. After 30 minutes, 20.0 mL of water was added to the mixture, low molecular weight substances were removed using a spectrum membrane, and desalination was performed. In addition, the mixture was diluted with water, thereby obtaining a pigment dispersion liquid 5 (content of the pigment: 10.0%) containing a self-dispersible pigment. In the pigment dispersion liquid 5, a self-dispersible pigment having a $—C_6H_3—(COOK)_2$ group bonded to a particle surface thereof was contained.

(Pigment Dispersion Liquid 6)

The kind of the pigment was changed to a solid solution (Cromophtal Jet Magenta 2BC, manufactured by Ciba) of C.I. pigment red 202 and C.I. pigment violet 19 in the preparation of the pigment dispersion liquid 5. Further, an amount of the treating agent was changed to 4.0 mmol. A pigment dispersion liquid 6 (content of pigment: 10.0%) was obtained by a procedure similar to that in the above-mentioned pigment dispersion liquid 5 except for the above-mentioned differences. In the pigment dispersion liquid 6, a self-dispersible pigment having a $—C_6H_3—(COOK)_2$ group bonded to a particle surface thereof was contained.

<Liquid Containing Dye>

A liquid (content of dye: 10.0%) containing a dye containing C.I. direct blue 199 was obtained.

<Preparation of Liquid Containing Resin>

(Liquid Containing Resin 1)

A 4-necked flask equipped with a stirrer, a nitrogen introducing tube, a reflux condenser, and a thermometer was charged with 100.0 parts of ethylene glycol monobutyl ether. While stirring, a temperature was increased to 110° C. under a nitrogen atmosphere. A liquid obtained by mixing 39.5 parts of styrene, 40.0 parts of methyl methacrylate, and 20.5 parts of acrylic acid with each other, and 1.3 parts of a polymerization initiator were added dropwise to the flask over 3 hours. Here, the used polymerization initiator was t-butylperoxide. Then, aging was performed thereon for 2 hours, and ethylene glycol monobutyl ether was removed under reduced pressure, thereby obtaining a solid resin 1. An aqueous solution of potassium hydroxide equivalent to an acid value and an appropriate amount of ion-exchange water were added to the solid resin, and the mixture was neutralized and dissolved at a temperature of 80° C., thereby obtaining a liquid containing the resin 1 in which a content of the resin 1 was 20.0%. The resin 1 was an acrylic resin and was a random copolymer.

(Liquid Containing Resin 2)

First, 31.6 parts of polypropylene glycol having a number average molecular weight of 2,000 was dissolved in methyl ethyl ketone by stirring. Then, 46.9 parts of isophorone diisocyanate and 21.5 parts of dimethylol propionic acid were added thereto, and the mixture was reacted at 75° C. for 1 hour, thereby obtaining a prepolymer solution. The obtained prepolymer solution was cooled to a temperature of 60° C., and an aqueous solution of potassium hydroxide was added thereto to neutralize an acid group. Then, the temperature was cooled to 40° C., ion exchange water was added thereto, and the mixture was emulsified by high-speed stirring with a homomixer. After emulsification, 2.1 parts of a chain extender was added thereto, and a chain extension reaction was carried out at 30° C. for 12 hours. When the presence of an isocyanate group was not confirmed by a Fourier transform infrared spectrophotometer (FT-IR), methyl ethyl ketone was distilled off from the solution under heating and reduced pressure, thereby obtaining a liquid containing resin 2 in which a content of the resin 2 was 20.0%. The resin 2 was a urethane resin and was a random copolymer.

(Liquid Containing Resin 3)

A 4-necked flask equipped with a stirrer, a nitrogen introducing tube, a reflux condenser, and a thermometer was charged with 100.0 parts of ethylene glycol monobutyl ether. While stirring, a temperature was increased to 110° C. under a nitrogen atmosphere. A liquid obtained by mixing 80.0 parts of styrene and 20.0 parts of polyethylene glycol (20.0 mol adduct) acrylate with each other, and 1.3 parts of a polymerization initiator were added dropwise to the flask over 3 hours. Here, the used polymerization initiator was t-butylperoxide. Then, aging was performed thereon for 2 hours, and ethylene glycol monobutyl ether was removed under reduced pressure, thereby obtaining a solid resin 3. An appropriate amount of ion-exchange water was added to the solid resin 3, and the mixture was dissolved at a temperature of 80° C., thereby obtaining a liquid containing the resin 3 in which a content of the resin 3 was 20.0%. The resin 3 was a non-ionic resin and was a random copolymer.

(Liquid Containing Resin 4)

After a four-necked flask equipped with a stirrer, a nitrogen introducing tube, a reflux condenser, and a thermometer was purged with nitrogen, 100.0 parts of dimethylformamide, 0.5 parts of pentamethyldiethylenetriamine, 5.2 parts of styrene, and 0.5 mmol of chloroethyl benzene as a initiator were added thereto. When a temperature reached 80° C. by heating while stirring, 0.1 parts of copper (I) chloride was added thereto to initiate polymerization, thereby synthesizing a hydrophobic unit formed of styrene. Further, 4.3 parts of trimethylsilyl acrylic acid was added to the mixture to perform a polymerization reaction while monitoring with column chromatography, and when the polymerization reaction was completed, 2.6 parts of n-butyl acrylate was further added to perform a polymerization reaction. After the polymerization reaction was stopped, a carboxyl group of trimethylsilyl acrylic acid was hydrolyzed with sodium hydroxide and an aqueous solution of methanol to thereby be converted to a carboxylic acid. After 2.8 g of a 35.0% aqueous solution of hydrochloric acid was added to this solution, stirred at room temperature for 10 minutes, and filtered, the resultant was washed three times with pure water, thereby obtaining a solid resin 4. The obtained resin 4 was dissolved in tetrahydrofuran, and potassium hydroxide was added to the solution so that a neutralization ratio of anionic groups of the resin became 80%. Further, after an appropriate amount of ion exchange water was added thereto and stirred, tetrahydrofuran was removed under reduced pressure, thereby obtaining a liquid containing the resin 4 in which a content of the resin 4 was 20.0%.

The presence of a peak by a chemical shift of the carboxylic group and hydrolysis of the carboxylic group of trimethylsilylacrylic acid were confirmed by proton nuclear magnetic resonance spectroscopy. The resin 4 was an acrylic resin and was a block copolymer. In addition, as a result of analyzing components constituting respective blocks by proton nuclear magnetic resonance spectroscopy, the component were styrene (52.4%), acrylic acid (21.8%), and n-butyl acrylate (25.8%).

(Liquid Containing Resin 5)

A four-necked flask equipped with a stirrer, a nitrogen introducing tube, a reflux condenser, and a thermometer was charged with 0.3 parts of sodium lauryl sulfate, 20.8 parts of 2-ethylhexyl acrylate, 62.4 parts of methyl methacrylate, and 16.8 parts of methacrylic acid. To the flask, 10.0 parts of a 5% aqueous solution of potassium persulfate was added dropwise over 3 hours. Thereafter, aging was performed for 2 hours, and an appropriate amount of ion exchange water was added thereto, thereby obtaining a liquid containing a resin 5 in which a content of the resin 5 was 20.0%.

The resins 1 to 4 were water-soluble resins, and the resin 5 was a resin particle. Whether the resin is water soluble or particulate can be determined by a method described below. First, a liquid (resin solid content: 10 mass %) containing a resin neutralized by alkali (sodium hydroxide, potassium hydroxide, or the like) equivalent to an acid value is prepared. Next, the prepared liquid is diluted 10 times with pure water (based on volume), thereby preparing a sample solution. Then, when a particle having a particle diameter is not measured in the case of measuring a particle diameter of the resin in the sample solution by the dynamic light scattering method, it can be determined that the resin is water soluble. When particles having a particle diameter are measured, it can be determined that the resin is a resin particle. In this case, for example, measurement conditions can be set as follows: SetZero: 30 seconds, measurement frequency: 3 times, and measurement time: 180 seconds. In Examples, as a particle size distribution analyzer, a particle size analyzer (UPA-EX150, manufactured by Nikkiso Co., Ltd.) using a dynamic light scattering method was used.

<Preparation of Ink>

Respective components illustrated in Table 1 were mixed and sufficiently stirred. Then, the mixture was subjected pressure-filtration using a cellulose acetate filter (manufactured by Advantech Co., Ltd.) having a pore size of 1.2 μm, thereby preparing ink. Acetylenol E100 is a non-ionic surfactant manufactured by Kawaken Fine Chemicals Co., Ltd. A numerical value attached to polyethylene glycol indicates a number average molecular weight. Relative dielectric constants $\varepsilon_{sol}$ of water-soluble organic solvents indicated in parentheses are values obtained at a frequency of 10 kHz using a dielectric constant meter (BI-870 manufactured by Brookhaven Instruments Corp.).

TABLE 1

Composition and Properties of Ink

| | Ink No. | | | | | | | | | | | | |
|---|---|---|---|---|---|---|---|---|---|---|---|---|---|
| | Black Ink 1 | Black Ink 2 | Black Ink 3 | Black Ink 4 | Black Ink 5 | Black Ink 6 | Black Ink 7 | Black Ink 8 | Black Ink 9 | Cyan Ink 1 | Cyan Ink 2 | Cyan Ink 3 | Cyan Ink 4 |
| Pigment Dispersion Liquid 1 | 30.0 | 30.0 | 30.0 | 30.0 | 30.0 | 30.0 | 30.0 | 30.0 | 30.0 | | | | |
| Pigment Dispersion Liquid 2 | | | | | | | | | | 30.0 | 30.0 | 30.0 | 30.0 |
| Pigment Dispersion Liquid 3 | | | | | | | | | | | | | |
| Pigment Dispersion Liquid 4 | | | | | | | | | | | | | |
| Pigment Dispersion Liquid 5 | | | | | | | | | | | | | |
| Pigment Dispersion Liquid 6 | | | | | | | | | | | | | |
| Liquid Containing Dye | | | | | | | | | | | | | |
| Liquid Containing Resin 1 | 10.0 | | | | | | 10.0 | 10.0 | 16.0 | 10.0 | | | |
| Liquid Containing Resin 2 | | 10.0 | | | | | | | | | 10.0 | | |
| Liquid Containing Resin 3 | | | 10.0 | | | | | | | | | 10.0 | |
| Liquid Containing Resin 4 | | | | 10.0 | | | | | | | | | 10.0 |
| Liquid Containing Resin 5 | | | | | 10.0 | | | | | | | | |
| Glycerin (42.3) | 12.0 | 12.0 | 12.0 | 12.0 | 12.0 | 12.0 | | | 12.0 | 12.0 | 12.0 | 12.0 | 12.0 |
| Triethylene glycol (22.7) | 12.0 | 12.0 | 12.0 | 12.0 | 12.0 | 12.0 | | 12.0 | 12.0 | 12.0 | 12.0 | 12.0 | 12.0 |
| 1,2-hexanediol (14.8) | | | | | | | 12.0 | 12.0 | | | | | |
| Polyethylene glycol 600 (11.4) | | | | | | | 12.0 | | | | | | |
| Acetylenol E100 | 1.0 | 1.0 | 1.0 | 1.0 | 1.0 | 1.0 | 1.0 | 1.0 | 1.0 | 1.0 | 1.0 | 1.0 | 1.0 |
| Ion Exchange Water | 35.0 | 35.0 | 35.0 | 35.0 | 35.0 | 45.0 | 35.0 | 35.0 | 29.0 | 35.0 | 35.0 | 35.0 | 35.0 |
| Content (%) of Resin | 2.0 | 2.0 | 2.0 | 2.0 | 2.0 | 0.0 | 2.0 | 2.0 | 3.2 | 3.2 | 3.2 | 3.2 | 3.2 |

TABLE 1-continued

| Composition and Properties of Ink | | | | | | | | | | |
|---|---|---|---|---|---|---|---|---|---|---|
| | Ink No. | | | | | | | | | |
| | Cyan Ink 5 | Cyan Ink 6 | Cyan Ink 7 | Cyan Ink 8 | Cyan Ink 9 | Cyan Ink 10 | Magenta Ink 1 | Magenta Ink 2 | Magenta Ink 3 | Yellow Ink 1 |
| Pigment Dispersion Liquid 1 | | | | | | | | | | |
| Pigment Dispersion Liquid 2 | 30.0 | 30.0 | 30.0 | 30.0 | | | | | | |
| Pigment Dispersion Liquid 3 | | | | | | | 30.0 | 30.0 | | |
| Pigment Dispersion Liquid 4 | | | | | | | | | | 30.0 |
| Pigment Dispersion Liquid 5 | | | | | 30.0 | | | | | |
| Pigment Dispersion Liquid 6 | | | | | | | | | 30.0 | |
| Liquid Containing Dye | | | | | | 30.0 | | | | |
| Liquid Containing Resin 1 | | 10.0 | 10.0 | 4.0 | | 10.0 | 10.0 | 5.0 | | 10.0 |
| Liquid Containing Resin 2 | | | | | | | | | | |
| Liquid Containing Resin 3 | | | | | | | | | | |
| Liquid Containing Resin 4 | | | | | | | | | | |
| Liquid Containing Resin 5 | 10.0 | | | | | | | | | |
| Glycerin (42.3) | 12.0 | | | 12.0 | 12.0 | 12.0 | 12.0 | 12.0 | | 12.0 |
| Triethylene glycol (22.7) | 12.0 | | 12.0 | 12.0 | 12.0 | 12.0 | 12.0 | 12.0 | | 12.0 |
| 1,2-hexanediol (14.8) | | 12.0 | 12.0 | | | | | | 12.0 | |
| Polyethylene glycol 600 (11.4) | | 12.0 | | | | | | | 12.0 | |
| Acetylenol E100 | 1.0 | 1.0 | 1.0 | 1.0 | 1.0 | 1.0 | 1.0 | 1.0 | 1.0 | 1.0 |
| Ion Exchange Water | 35.0 | 35.0 | 35.0 | 41.0 | 45.0 | 35.0 | 35.0 | 40.0 | 45.0 | 35.0 |
| Content (%) of Resin | 3.2 | 3.2 | 3.2 | 2.0 | 0.0 | 2.0 | 3.2 | 2.2 | 0.0 | 3.2 |

<Evaluation>

In the present invention, as the evaluation criteria for evaluation described below, "AA", "A", and "B" were set as acceptable levels, and "C" was set as unacceptable level. Evaluation results are shown in Table 3. The ink is mounted in a recording head having a single recording element substrate using an ink jet recording apparatus having the configuration illustrated in FIGS. 4A and 4B. As the recording head, recording heads 1 to 5 illustrated in Table 2 were used.

In Table 2, ejection orifice arrays of a recording element substrate correspond to the ejection orifice arrays I to IV illustrated in FIGS. 1A to 1C. In recording element substrates of the recording heads 1 to 3 and 5, the ejection orifice arrays overlap each other in a conveying direction of a recording medium, but in a recording element substrate of the recording head 4, the ejection orifice arrays do not overlap each other in the conveying direction of the recording medium. Further, the recording head 2 has the ejection orifice arrays I to III, but the ink is not ejected from the ejection orifice array II.

In the recording heads 1 to 5, the number of ejection orifices per one ejection orifice array was 1024, and a density of the ejection orifices per one ejection orifice array was 600 dpi. In addition, a long diameter (μm) passing through the center of the ejection orifice was 20 μm, and a distance (mm) between adjacent ejection orifice arrays was 0.7 mm. In addition, an ejection orifice surface of the recording head was subjected to water-repellent treatment by a condensate of a hydrolyzable silane compound having a fluoroalkyl group and a hydrolyzable silane compound having a cationic polymerizable group.

In Examples, an image recorded under a condition at which three ink droplets (5.0 ng) were applied to a unit area of 1/600 inch×1/600 inch was defined as an image with a recording duty of 100%, and a conveyance speed of the recording medium was 15 inch/second. In the case of conveying the recording medium in a direction from the ejection orifice array I to the ejection orifice array II ("I→II" in Table 3), at the time of recording the image, the recording medium is conveyed from a bottom to a top in the direction of gravity. In the case of conveying the recording medium in a direction from the ejection orifice array II to the ejection orifice array I ("II→I" in Table 3), at the time of recording the image, the recording medium is conveyed from the top to the bottom in the direction of gravity.

TABLE 2

| Configuration of Recording Head | | | | | | |
|---|---|---|---|---|---|---|
| | | Recording Head No. | | | | |
| | | 1 | 2 | 3 | 4 | 5 |
| Structure of Recording Element Substrate | Ejection Orifice Array IV | Absence | Absence | Absence | Absence | Absence |
| | Ejection Orifice Array III | Absence | Presence | Absence | Absence | Absence |
| | Ejection Orifice Array II | Presence | Presence | Presence | Presence | Presence |
| | Ejection Orifice Array I | Presence | Presence | Presence | Presence | Presence |
| Angle (°) between Ejection Orifice Surface and Gravity Direction | | 45 | 45 | 90 | 45 | 0 |

(Color Mixing of Image)

Except for Reference Examples 4 and 5, the ejection orifice surface was wiped using the cleaning device illustrated in FIG. 5. A material of a wiper is rubber. When the wiper came in slide-contact with the ejection orifice surface of the recording head, the wiper was largely bent, such that a side portion thereof came in contact with the ejection orifice surface, and a contact pressure with the ejection orifice surface was 1 N. The ejection orifice surface was wiped by setting a speed of the wiper from the ejection orifice array I to the ejection orifice array IV to 80 millimeter/second.

First, a single color solid image (about 3 cm in the conveying direction of the recording medium×about 4 cm in the depth direction of the apparatus) having a recording duty of 100% was recorded using each of the inks. The obtained image was used as an evaluation image 1. Thereafter, after the recording was stopped for 1 hour, the ejection orifice surface was wiped once. Then, a solid image having a plurality of colors (about 17 cm in the conveying direction of the recording medium×about 4 cm in the depth direction of the apparatus) were continuously recorded on 50 sheets using each of the inks so that the recording duty of each of the inks was the same and a total recording duty of the inks was 100%. After repeating a series of operations such as a pause, cleaning, and continuous recording a predetermined number of times, a single color solid image (about 3 cm in the conveying direction of the recording medium×about 4 cm in the depth direction of the apparatus) having a recording duty of 100% was recorded again using each of the inks. The obtained image was used as an evaluation image 2. As the recording medium, plain paper (PPC paper, PB paper manufactured by Canon Inc.) was used. In Reference Examples 4 and 5, the ejection orifice surface was not wiped.

The evaluation images 1 and 2 were visually observed, thereby evaluating whether color mixing occurred in the evaluation image 2.

AA: Even though the series of operations was repeated 10,000 times, there was no color mixing in the evaluation image 2.

A: When the series of operations was repeated 8,000 times or more to less than 10,000 times, color mixing occurred in the evaluation image 2.

B: When the series of operations was repeated 6,000 times or more to less than 8,000 times, color mixing occurred in the evaluation image 2.

C: When the series of operations was repeated less than 6,000 times, color mixing occurred in the evaluation image 2.

As Reference Example 10, an image was recorded using an ink jet recording apparatus sequentially including two recording heads corresponding to black ink 9 and cyan ink 8 from an upstream side in the conveying direction of the recording medium. As a result of recording the image using the same method as in Comparative Example 3 except for using two recording heads, color mixing in the image was evaluated as AA corresponding to the acceptable level.

As Reference Example 11, an image was recorded using an ink jet recording apparatus sequentially including two recording heads corresponding to black ink 1 and cyan ink 1 from the upstream side in the conveying direction of the recording medium. As a result of recording the image using the same method as in Example 1 except for using two recording heads, color mixing in the image was evaluated as AA corresponding to the acceptable level.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-201260, filed Oct. 17, 2017, and No. 2018-180361, filed Sep. 26, 2018, which are hereby incorporated by reference herein in their entirety.

TABLE 3

Evaluation Results

| | Evaluation Conditions | | | | | Evaluation |
|---|---|---|---|---|---|---|
| | Conveying Direction of Recording Medium | Recording Head No. | Kind of Ink of Ejection Orifice Array I | Kind of Ink of Ejection Orifice Array II | Kind of Ink of Ejection Orifice Array III | Result Color Mixing of Image |
| Example 1 | I→II | 1 | Black Ink 1 | Cyan Ink 1 | — | AA |
| Example 2 | I→II | 1 | Black Ink 1 | Magenta Ink 1 | — | AA |
| Example 3 | I→II | 1 | Black Ink 1 | Yellow Ink 1 | — | AA |
| Example 4 | I→II | 5 | Black Ink 1 | Cyan Ink 1 | — | AA |
| Example 5 | I→II | 1 | Black Ink 2 | Cyan Ink 2 | — | AA |
| Example 6 | I→II | 1 | Black Ink 3 | Cyan Ink 3 | — | AA |
| Example 7 | I→II | 1 | Black Ink 4 | Cyan Ink 4 | — | AA |
| Example 8 | I→II | 1 | Black Ink 5 | Cyan Ink 5 | — | AA |
| Example 9 | I→II | 1 | Black Ink 1 | Cyan Ink 2 | — | AA |
| Example 10 | I→II | 1 | Black Ink 1 | Cyan Ink 3 | — | AA |
| Example 11 | I→II | 1 | Black Ink 1 | Cyan Ink 4 | — | AA |
| Example 12 | I→II | 1 | Black Ink 1 | Cyan Ink 5 | — | AA |
| Example 13 | I→II | 1 | Magenta Ink 2 | Cyan Ink 1 | — | AA |
| Example 14 | I→II | 1 | Black Ink 6 | Cyan Ink 1 | — | A |
| Example 15 | I→II | 1 | Black Ink 7 | Cyan Ink 1 | — | A |
| Example 16 | I→II | 1 | Black Ink 1 | Cyan Ink 6 | — | A |
| Example 17 | I→II | 1 | Black Ink 7 | Cyan Ink 6 | — | B |
| Example 18 | I→II | 1 | Black Ink 8 | Cyan Ink 7 | — | A |
| Example 19 | I→II | 1 | Magenta Ink 3 | Cyan Ink 6 | — | B |
| Example 20 | II→I | 1 | Black Ink 1 | Cyan Ink 1 | — | AA |
| Comparative Example 1 | I→II | 5 | Black Ink 9 | Cyan Ink 8 | — | C |
| Comparative Example 2 | I→II | 1 | Black Ink 6 | Cyan Ink 9 | — | C |
| Comparative Example 3 | I→II | 1 | Black Ink 9 | Cyan Ink 8 | — | C |
| Comparative Example 4 | I→II | 1 | Black Ink 1 | Cyan Ink 9 | — | C |
| Reference Example 1 | I→II | 1 | Black Ink 1 | Cyan Ink 10 | — | AA |
| Reference Example 2 | I→II | 1 | Black Ink 1 | Black Ink 1 | — | AA |
| Reference Example 3 | I→II | 2 | Black Ink 1 | — | Cyan Ink 1 | AA |
| Reference Example 4 | I→II | 1 | Black Ink 1 | Cyan Ink 1 | — | AA |
| Reference Example 5 | I→II | 1 | Black Ink 9 | Cyan Ink 8 | — | AA |
| Reference Example 6 | I→II | 3 | Black Ink 1 | Cyan Ink 1 | — | AA |
| Reference Example 7 | I→II | 3 | Black Ink 9 | Cyan Ink 8 | — | AA |
| Reference Example 8 | I→II | 4 | Black Ink 1 | Cyan Ink 1 | — | AA |
| Reference Example 9 | I→II | 4 | Black Ink 9 | Cyan Ink 8 | — | AA |

What is claimed is:

1. An ink jet recording method using an ink jet recording apparatus that includes (i) first and second inks corresponding to aqueous inks comprising a pigment, (ii) a recording head in which a first ejection orifice array for ejecting the first ink and a second ejection orifice array for ejecting the second ink are sequentially arranged from the bottom up in the direction opposite to the direction of gravity to be adjacent to each other and the first and second ejection orifice arrays are arranged to at least partially overlap each other in a conveying direction of a recording medium, and (iii) a cleaning member for cleaning an ejection orifice surface of the recording head in which the first and second ejection orifice arrays are formed, the ink jet recording method comprising:

(a) ejecting an aqueous ink from the recording head disposed so that an angle formed between the ejection orifice surface and the direction of gravity is 0° or more to less than 90° to record an image on the recording medium, wherein the ejection orifice surface is parallel to the direction of gravity when the angle is 0°; and (b) cleaning the ejection orifice surface, wherein at least one of the first and second inks comprises a resin, and wherein a content of the resin in the second ink is larger than a content of the resin in the first ink.

2. The ink jet recording method according to claim 1, wherein the pigment of the first ink includes carbon black.

3. The ink jet recording method according to claim 1, wherein both of the first and second inks comprise the resin.

4. The ink jet recording method according to claim 1, wherein both of the first and second inks comprise a first water-soluble organic solvent having a relative dielectric constant of 20.0 or more.

5. The ink jet recording method according to claim 1, wherein the recording head includes a single recording element substrate in which the first and second ejection orifice arrays are arranged.

6. The ink jet recording method according to claim 5, wherein the recording head includes a plurality of recording element substrates.

7. The ink jet recording method according to claim 6, wherein the plurality of recording element substrates is arranged to be adjacent to each other in an arrangement direction of the first ejection orifice array and the second ejection orifice array.

8. An ink jet recording apparatus comprising:

(a) first and second inks corresponding to aqueous inks comprising a pigment;

(b) a recording head in which a first ejection orifice array for ejecting the first ink and a second ejection orifice array for ejecting the second ink are sequentially arranged from the bottom up in the direction opposite to the direction of gravity to be adjacent to each other and the first and second ejection orifice arrays are arranged to at least partially overlap each other in a conveying direction of a recording medium; and (c) a cleaning member for cleaning an ejection orifice surface of the recording head in which the first and second ejection orifice arrays are formed, wherein an image is recorded on the recording medium by ejecting an aqueous ink from the recording head that is disposed so that an angle formed between the ejection orifice surface and the direction of gravity is 0° or more to less than 90°, wherein the ejection orifice surface is parallel to the direction of gravity when the angle is 0°, wherein at least one of the first and second inks comprises a resin, and wherein a content of the resin in the second ink is larger than a content of the resin in the first ink.

9. The ink jet recording method according to claim 1, wherein an angle formed between the ejection orifice surface of the recording head and the direction of gravity is 10° or more to 80° or less.

10. The ink jet recording method according to claim 1, wherein an angle formed between the ejection orifice surface of the recording head and the direction of gravity is 30° or more to 60° or less.

11. The ink jet recording method according to claim 1, wherein the conveying direction of the recording medium is from the first ejection orifice array to the second ejection orifice array.

12. The ink jet recording method according to claim 1, wherein the ejection orifice surface is subjected to a water-repellent treatment.

13. The ink jet recording method according to claim 1, wherein the cleaning member is a wiper.

14. The ink jet recording method according to claim 13, wherein the wiper is moved in a direction intersecting an arrangement direction of the first ejection array and the second ejection array.

15. The ink jet recording method according to claim 1, wherein the resin comprises an acrylic resin.

* * * * *